US008007261B2

(12) United States Patent
Caillat

(10) Patent No.: US 8,007,261 B2
(45) Date of Patent: Aug. 30, 2011

(54) THERMALLY COMPENSATED SCROLL MACHINE

(75) Inventor: Jean-Luc M. Caillat, Dayton, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 1047 days.

(21) Appl. No.: 11/647,463

(22) Filed: Dec. 28, 2006

(65) Prior Publication Data

US 2008/0159893 A1 Jul. 3, 2008

(51) Int. Cl.
*F03C 2/00* (2006.01)
*F03C 4/00* (2006.01)
*F04C 2/00* (2006.01)

(52) U.S. Cl. ..... 418/55.5; 418/55.2; 418/57; 418/179

(58) Field of Classification Search ..... 418/55.1–55.6, 418/57, 178, 179
See application file for complete search history.

(56) References Cited

U.S. PATENT DOCUMENTS

| | | | | |
|---|---|---|---|---|
| 4,199,308 | A * | 4/1980 | McCullough | 418/55.4 |
| 4,548,555 | A | 10/1985 | Hiraga et al. | |
| 4,730,998 | A | 3/1988 | Kakuda et al. | |
| 4,761,122 | A | 8/1988 | Matsugi et al. | |
| 4,808,094 | A | 2/1989 | Sugimoto et al. | |
| 4,836,758 | A | 6/1989 | Elson et al. | |
| 5,015,163 | A | 5/1991 | Iizuka | |
| 5,114,322 | A | 5/1992 | Caillat et al. | |
| 5,125,810 | A | 6/1992 | Suefuji et al. | |
| 5,174,738 | A | 12/1992 | Baumann et al. | |
| 5,222,881 | A | 6/1993 | Sano et al. | |
| 5,312,229 | A | 5/1994 | Sano et al. | |
| 5,407,334 | A | 4/1995 | Sano et al. | |
| 5,439,360 | A | 8/1995 | Barito | |
| 5,474,433 | A | 12/1995 | Chang et al. | |
| 5,496,158 | A | 3/1996 | Barito et al. | |
| 5,573,389 | A | 11/1996 | Fukuhara et al. | |
| 5,829,959 | A * | 11/1998 | Tsubono et al. | 418/55.5 |
| 5,857,844 | A | 1/1999 | Lifson et al. | |

FOREIGN PATENT DOCUMENTS

| | | | | |
|---|---|---|---|---|
| JP | 01195987 | A * | 8/1989 | |
| JP | 04153589 | A * | 5/1992 | 418/55.5 |
| JP | 08086287 | | 4/1996 | |
| JP | 11264386 | A | 9/1999 | |
| KR | 20000007578 | | 2/2000 | |
| KR | 20030012662 | | 2/2003 | |

OTHER PUBLICATIONS

Russell H. King, "Thermopolymer-Driven Actuators Challenge Hydraulics," Design News, Feb. 20, 1995, 2 Pages.

(Continued)

*Primary Examiner* — Theresa Trieu
(74) *Attorney, Agent, or Firm* — Harness, Dickey & Pierce, P.L.C.

(57) ABSTRACT

The scroll machine has a first and a second scroll member each having intermeshed scroll wraps. A compensation member is attached to one of the scrolls. As the scroll machine warms to operating temperature, the compensation member exerts a force on the one scroll member causing it to deflect. The deflection of the scroll member compensates for the unequal growth of the scroll wrap which is caused by a temperature difference between the radially inner section and the radially outer section of the scroll wrap.

45 Claims, 7 Drawing Sheets

OTHER PUBLICATIONS

Rostra Vernatherm, Thermally Activated Linear Actuators, www.rostravernatherm.com/thermal-actuators.htm, 2005, 2 Pages.
Written Opinion of the International Searching Authority dated Apr. 23, 2008 regarding International Application No. PCT/US2007/025476.
International Search Report dated Apr. 23, 2008 regarding International Application No. PCT/US2007/025476.
International Preliminary Report on Patentability regarding International Application No. PCT/US2007/025476 dated Jun. 30, 2009.

* cited by examiner

THERMALLY COMPENSATED SCROLL MACHINE

FIELD

The present disclosure relates to scroll machines. More particularly, the present disclosure relates to scroll compressors having a pair of scroll members which incorporate a thermal compensation system which changes the contour of at least one of the end plates of the scroll members in response to changes in temperature.

BACKGROUND AND SUMMARY

The statements in this section merely provide background information related to the present disclosure and may not constitute prior art.

Scroll type machines are becoming more and more popular for use as compressors in both refrigeration as well as air conditioning applications due primarily to their capability for extremely efficient operation. Generally, these machines incorporate a pair of intermeshed spiral wraps, one of which is caused to orbit relative to the other so as to define one or more moving chambers which progressively decrease in size as they travel from an outer suction port toward a center discharge port. Typically one of the scroll members is stationary and the other is orbiting. An electric motor is provided which operates to drive the orbiting scroll member via a suitable drive shaft affixed to the motor rotor. In a hermetic compressor, the bottom of the hermetic shell normally contains an oil sump for lubricating and cooling purposes.

Scroll compressors depend upon a number of seals to be created to define the moving or successive chambers. One type of seals which must be created are the seals between opposed flank surfaces of the wraps. These flank seals are created adjacent to the outer suction port and travel radially inward along the flank surface due to the orbiting movement of one scroll with respect to the other scroll. The other type of sealing is one required between the end plate of one scroll and the tip of the wrap of the other scroll. This tip to end plate sealing has been the subject of numerous designs and developments in the scroll compressor field.

One solution to the creation of tip seals has been to machine a groove in the end surface of the wrap and insert a sealing member which can be biased away from the wrap and towards the end plate of the opposite scroll. Unfortunately, due to the machining of the groove, the manufacture of the sealing member and the assembly of these components, the costs associated with incorporating tip seals are not insignificant. Also, the tip seals themselves introduce additional radial and tangential leak paths that are not insignificant, especially in smaller machines. They also introduce additional reliability and durability concerns as they are wear prone elements.

Other designs for scroll compressors have incorporated axial biasing of one scroll with respect to the opposing scroll. The axial biasing operates to urge the tips of the scroll members against their opposing end plate in order to enhance the sealing at the tip of the wrap. The biasing of one scroll member with respect to the opposing scroll member in conjunction with dimensional control of the scroll members themselves has allowed scroll compressors to be manufactured without separate tip sealing members between the tip of the wrap and the opposing end plate.

The dimensional control of the scroll members is capable of producing a scroll wrap which mates with the opposing end plate. When axial biasing is incorporated, the scroll wrap tips are biased against the opposing end plate to provide the necessary sealing. A scroll machine compresses fluid using fluid chambers which move radially inward toward the inner section of the scroll wrap while their volume is decreased to compress the fluid. The compression of the fluid causes the generation of heat such that the scroll wrap is hotter at its radially inner section than at its radially outer section. The difference in temperature of the inner and outer sections of the wrap will result in a difference in the thermal expansion between the inner and outer sections of the wrap and thus the possibility of creating a leak path between the scroll wrap tips and its opposing end plate in at least a portion of the scroll wrap. In addition to creating a leak path between the scroll wrap tips and the opposing end plate, the growth of the inner most section may result in reduced tip to end plate contact bearing area and the possibility of galling the end plate by the scroll wrap is created.

Various methods have been devised to accommodate the unequal growth in the height of the scroll wrap due to thermal expansion. Some designs have provided for machining the scroll wraps such that they are progressively shorter as they approach the central area. In this manner, once the compressor reaches an intended operating temperature, the unequal thermal expansion of the scroll wrap will create a matched height of the scroll wrap for both members. The disadvantages to this design approach include the inherent leak path which is present when the compressor is not operating at the intended operating temperature; as well as determining what the intended operating temperature is when the compressor is in an environment which can drastically change temperatures such as a compressor located outside where temperatures change between winter and summer. Additionally, the manufacturing techniques and controls to produce the tapered wrap can significantly add to the overall cost of the scroll machine. Other designs have proposed variations to the above described wrap height variation such as the radially outer portion being constant in height, the middle portion being progressively shorter and the radially inner portion being constant in height. The disadvantages to these designs are the same as those described above for the progressively shorter designs.

Continued development of scroll machines includes the development of methods for accommodating the difference in thermal expansion of the wraps which is caused by the temperature gradient which occurs between the radially outer portion and the radially inner portion of the scroll machine.

The present disclosure provides the art with a scroll machine which continuously adjusts to the variation of the height of the scroll wrap so that the tip of the wrap and the opposing end plate provide sealing contact between these components during the various operating temperatures experienced by the scroll wraps. The present disclosure utilizes a scroll member which has a first portion which is manufactured from a material having a first coefficient of thermal expansion and a second portion which is manufactured from a material having a second coefficient of thermal expansion. As the temperature of the scroll member changes, the two materials react differently to the temperature change due to the difference in their coefficient of thermal expansion to compensate for the thermal expansion and adjust the relationship between the scroll wrap and the opposing end plate. One aspect of this disclosure is that the cause of the distortion itself, that leads to improper sealing, namely the temperature distribution in the member, can be used to counteract the distortion.

Other advantages and objects of the present disclosure will become apparent to those skilled in the art from the subsequent detailed description, appended claims and drawings.

DRAWINGS

The drawings described herein are for illustration purposes only and are not intended to limit the scope of the present disclosure in any way.

DESCRIPTION

The following description is merely exemplary in nature and is not intended to limit the present disclosure, application, or uses.

Figure 1:
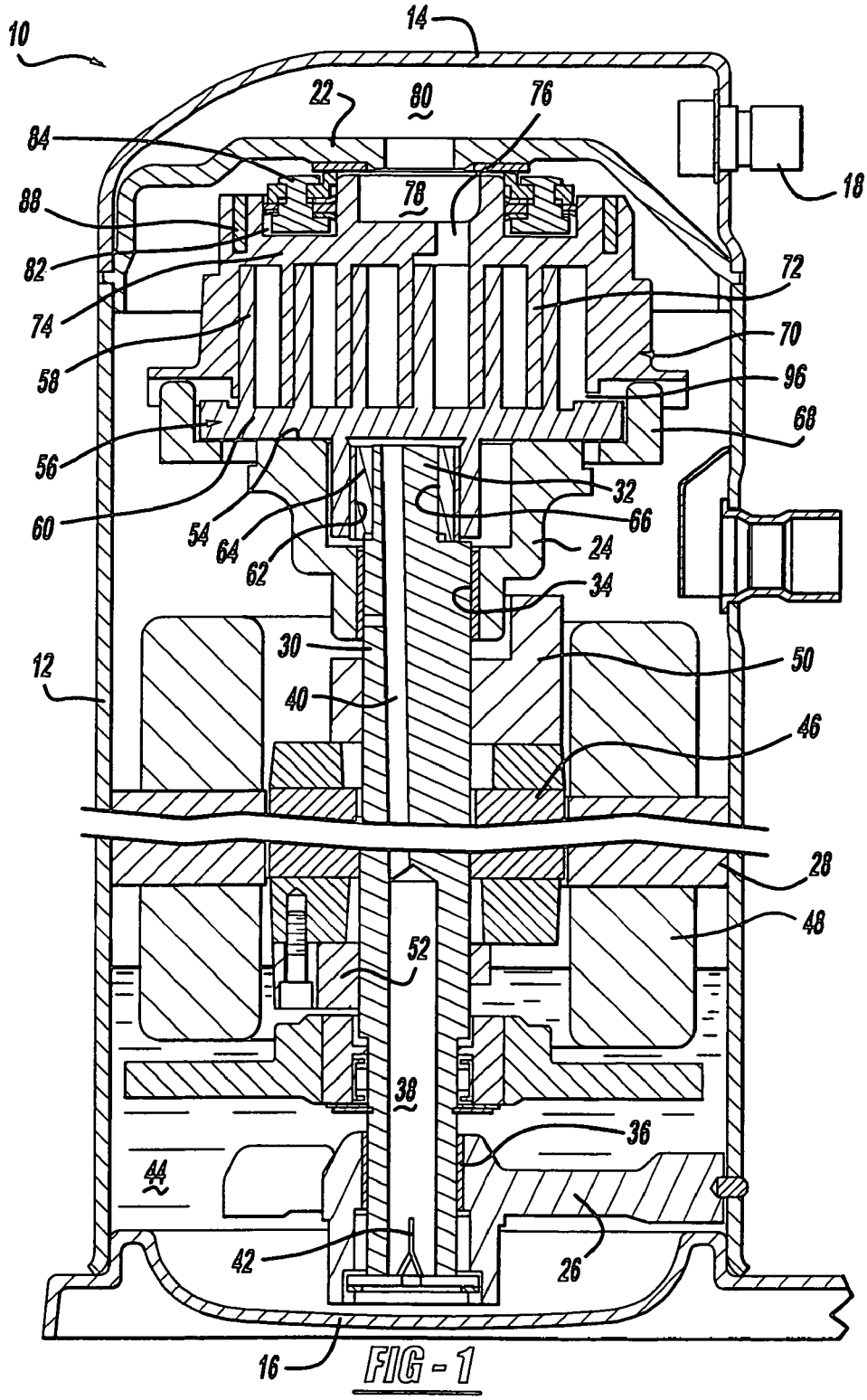
FIG. 1 is a vertical cross-sectional view through the center of a scroll type refrigeration compressor incorporating a compensation system in accordance with the present disclosure.

Referring now to the drawings in which like reference numerals designate like or corresponding parts throughout the several views, there is shown in FIG. 1 a scroll compressor which incorporates a compensation system in accordance with the present disclosure which is designated generally by reference numeral 10. Compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to the shell include a transversely extending partition 22 which is welded about its periphery at the same point that cap 14 is welded to shell 12, a main bearing housing 24 which is suitably secured to shell 12 and a lower bearing housing 26 also having a plurality of radially outwardly extending legs each of which is also suitably secured to shell 12. A motor stator 28 which is generally square in cross-section but with the corners rounded off is press fitted into shell 12. The flats between the rounded corners on the stator provide passageways between the stator and shell, which facilitate the return flow of lubricant from the top of the shell to the bottom.

A drive shaft or crankshaft 30 having an eccentric crank pin 32 at the upper end thereof is rotatably journaled in a bearing 34 in main bearing housing 24 and a second bearing 36 in lower bearing housing 26. Crankshaft 30 has at the lower end a relatively large diameter concentric bore 38 which communicates with a radially outwardly inclined smaller diameter bore 40 extending upwardly therefrom to the top of crankshaft 30. Disposed within bore 38 is a stirrer 42. The lower portion of the interior shell 12 defines an oil sump 44 which is filled with lubricating oil to a level slightly below the lower end of a rotor 46 but above the lower end of stator end-turns of windings 48, and bore 38 acts as a pump to pump lubricating fluid up the crankshaft 30 and into bore 40 and ultimately to all of the various portions of the compressor which require lubrication.

Crankshaft 30 is rotatively driven by an electric motor including stator 28, windings 48 passing therethrough and rotor 46 press fitted on the crankshaft 30 and having upper and lower counterweights 50 and 52, respectively.

The upper surface of main bearing housing 24 is provided with a flat thrust bearing surface 54 on which is disposed an orbiting scroll member 56 having the usual spiral vane or wrap 58 extending upward from an end plate 60. Projecting downwardly from the lower surface of end plate 60 of orbiting scroll member 56 is a cylindrical hub having a journal bearing 62 therein and in which is rotatively disposed a drive bushing 64 having an inner bore 66 in which crank pin 32 is drivingly disposed. Crank pin 32 has a flat on one surface which drivingly engages a flat surface (not shown) formed in a portion of bore 66 to provide a radially compliant driving arrangement, such as shown in assignee's U.S. Pat. No. 4,877,382, the disclosure of which is hereby incorporated herein by reference. An Oldham coupling 68 is also provided positioned between orbiting scroll member 56 and main bearing housing 24 and keyed to orbiting scroll member 56 and a non-orbiting scroll member 70 to prevent rotational movement of orbiting scroll member 56. Oldham coupling 68 is preferably of the type disclosed in assignee's co-pending U.S. Pat. No. 5,320,506, the disclosure of which is hereby incorporated herein by reference.

Non-orbiting scroll member 70 is also provided having a wrap 72 extending downwardly from an end plate 74 which is positioned in meshing engagement with wrap 58 of orbiting scroll member 56. Non-orbiting scroll member 70 has a centrally disposed discharge passage 76 which communicates with an upwardly open recess 78 which in turn is in fluid communication with a discharge muffler chamber 80 defined by cap 14 and partition 22. An annular recess 82 is also formed in non-orbiting scroll member 70 within which is disposed a seal assembly 84. Recesses 78 and 82 and seal assembly 84 cooperate to define axial pressure biasing chambers which receive pressurized fluid being compressed by wraps 58 and 72 so as to exert an axial biasing force on non-orbiting scroll member 70 to thereby urge the tips of respective wraps 58, 72 into sealing engagement with the opposed end plate surfaces of end plates 74 and 60, respectively. Seal assembly 84 is preferably of the type described in greater detail in U.S. Pat. No. 5,156,539, the disclosure of which is hereby incorporated herein by reference. Non-orbiting scroll member 70 is designed to be mounted to main bearing housing 24 in a suitable manner such as disclosed in the aforementioned U.S. Pat. No. 4,877,382 or U.S. Pat. No. 5,102,316, the disclosure of which is hereby incorporated herein by reference.

Figure 2:
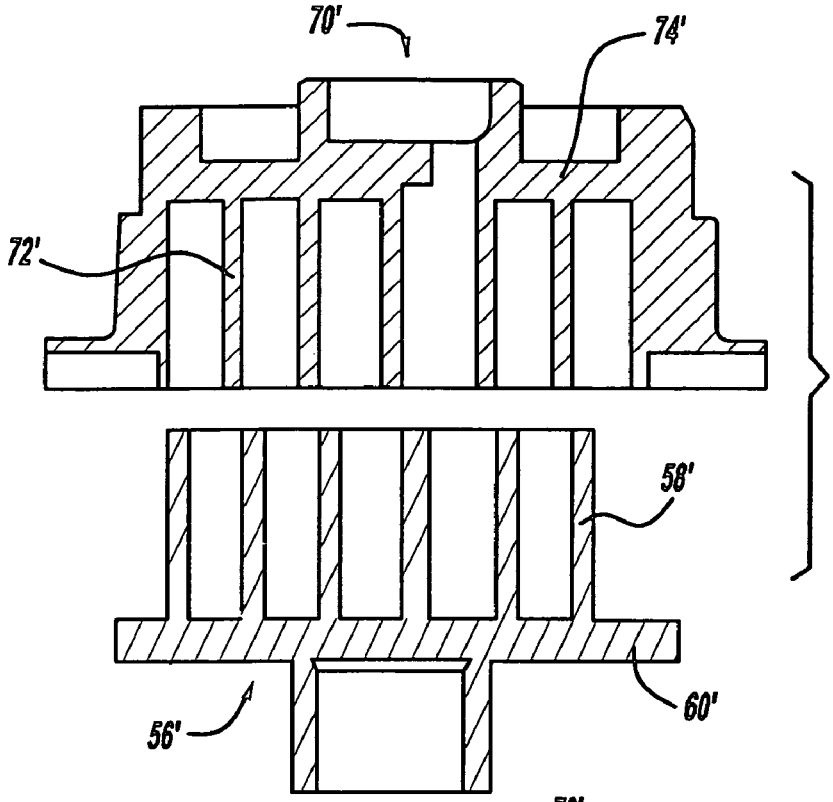
FIG - 2 Prior Art
FIG. 2 is a schematic view of a prior art orbiting and non-orbiting scroll members at normal room temperature.
Figure 3:
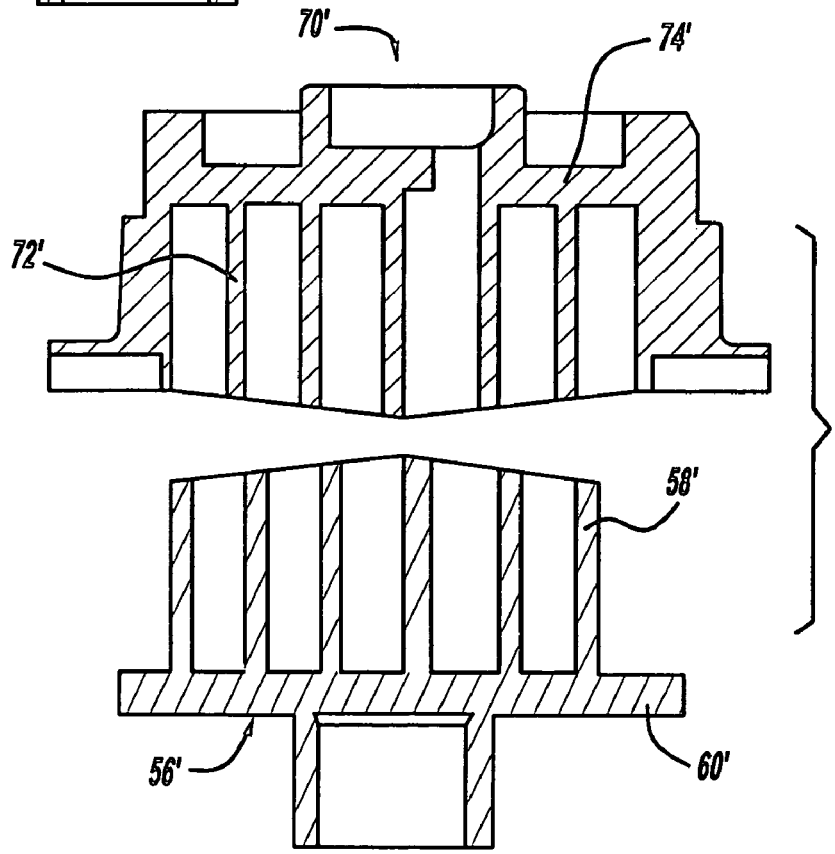
FIG - 3 Prior Art
FIG. 3 is a schematic view of the prior art orbiting and non-orbiting scroll members illustrated in FIG. 2 at an elevated temperature without the influence of the compensation member of the present disclosure.

Referring now to FIGS. 2 and 3, a prior art set of scroll members without the temperature compensation in accordance with the present disclosure is illustrated. FIG. 2 illustrates an orbiting scroll member 56' and a non-orbiting scroll member 70' at a normal environmental temperature. The surface of end plate 60' of the orbiting scroll member 56' extending between scroll wrap 58' is formed as a generally planar surface. Similarly, the surface of end plate 74' of the non-orbiting scroll member 70' extending between scroll wrap 72' is also formed as a generally planar surface. In this manner, when orbiting scroll member 56' and non-orbiting scroll member 70' are assembled, the flank surfaces of scroll wraps 58' and 72' engage each other, the tips of scroll wrap 58' engage end plate 74' and the tips of scroll wrap 72' engage end plate 60' to provide for the sealing of the compression pockets.

FIG. 3 illustrates the thermal expansion effects due to normal operating temperature on prior art orbiting scroll member 56' and non-orbiting scroll member 70' without the compensating effect of the temperature compensation system of the present disclosure. The higher temperature of the radially inner portion of wraps 58' and 72' cause the radially inner portion of wraps 58' and 72' to grow to a larger extent than the radially outer portion of the wraps causing the tip of wraps 58' and 72' to each form somewhat of a convex shape while the mating surface of end plates 60' and 74' maintain a general planar configuration. The engagement between the scroll wraps 58' and 72' and the respective scroll tips and end plates 74' and 60' will result in a leak path at the radially outer portion between the tips of wraps 58' and 72' and end plates 74' and 60', respectively.

Figure 4:
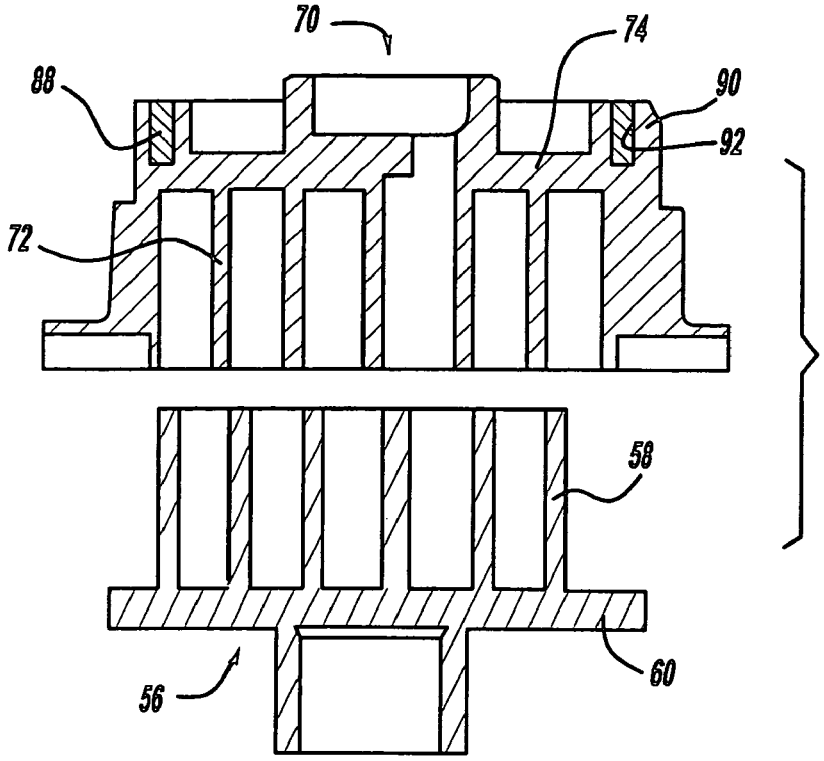
FIG. 4 is a schematic view of the orbiting and non-orbiting scroll members illustrated in FIG. 1 at normal room temperature.
Figure 5:
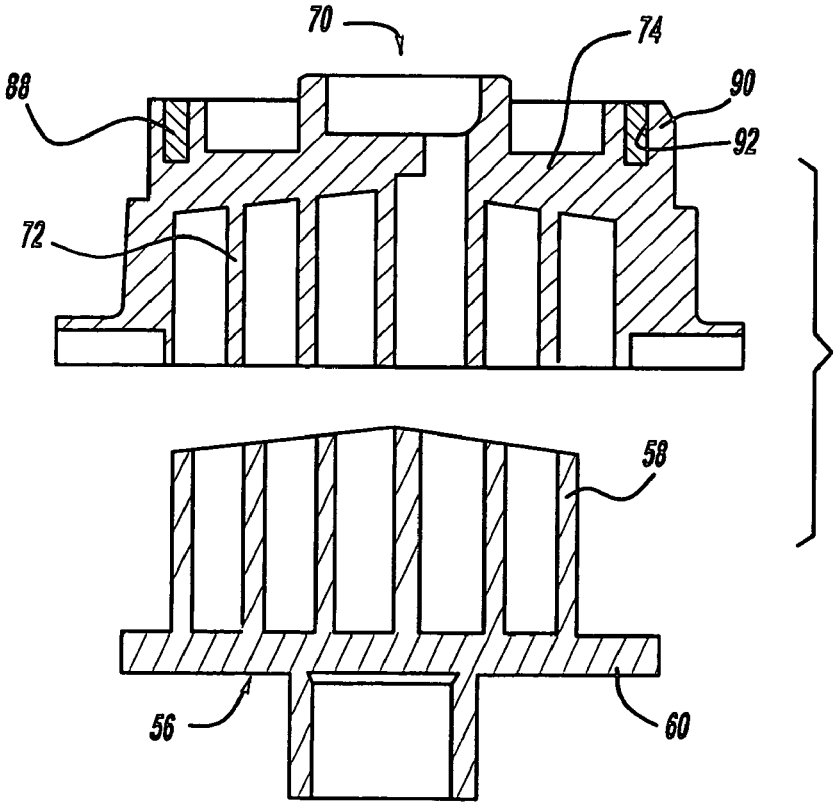
FIG. 5 is a schematic view of the orbiting and non-orbiting scroll members shown in FIG. 4 at an elevated operating temperature with the influence of the compensation member.

Referring now to FIGS. 1, 4 and 5, the temperature compensation system in accordance with the present disclosure comprises an annular ring 88 attached to non-orbiting scroll member 70. Non-orbiting scroll member 70 defines an annular flange 90 projecting upwardly from end plate 74 of non-orbiting scroll member 70. Annular flange 90 defines an annular groove 92 within which is located annular ring 88. Annular ring 88 is press fit within annular groove 92 or secured within annular groove 92 by other means known in the art. The reaction to temperature change or the coefficient of thermal expansion for the material of annular ring 88 is greater than the reaction to temperature change or the coefficient of thermal expansion of the material of non-orbiting scroll member 70. Annular ring 88 may be manufactured from standard wrought materials, composite materials, shaped memory alloys, phase changing alloys or any other material known in the art that will provide the desired results.

FIGS. 4 and 5 schematically illustrates the operating principles for the temperature compensation system shown in FIG. 1. FIG. 4 illustrates orbiting scroll member 56 and non-orbiting scroll member 70 at a normal environmental or room temperature. The surface of end plate 60 extending between scroll wrap 58 is formed as a generally planar surface. Similarly, the surface of end plate 74 extending between scroll wrap 72 is also formed as a generally planar surface. In this manner, when orbiting scroll member 56 and non-orbiting scroll member 70 are assembled at room temperature, the flank surfaces of scroll wraps 58 and 72 engage each other, the tip of scroll wrap 58 engages end plate 74 and the tip of scroll wrap 72 engages end plate 60 to provide for the sealing of the compression pockets.

FIG. 5 illustrates the thermal expansion effects due to normal operating temperature on orbiting scroll member 56 and non-orbiting scroll member 70 with the compensation effect of annular ring 88. It has been observed that end plate 60 remains generally planar and provides continued proper engagement with generally flat thrust bearing surface 54 of main bearing housing 24. The incorporation of annular ring 88 does not affect the thermal growth resulting in the convex shape of wraps 58. The effect of the incorporation of annular ring 88 is only on non-orbiting scroll member 70. As the temperature of non-orbiting scroll member 70 increases, the temperature of annular ring 88 also increases. This causes thermal expansion of annular ring 88 in an amount which is greater than the thermal expansion of annular flange 90 due to the differences in the coefficients of thermal expansion of their materials. This difference in thermal expansion will produce a load on annular flange 90 which will cause end plate 74 to form a concave surface which will reduce or eliminate the convex shape for the tips of wrap 72. With the proper selection of materials such as copper based materials or ferrous based materials with austenitic structure which have a coefficient of thermal expansion higher than that of scroll members made of grey iron to choose from typical wrought materials, and the proper dimensioning of the components, the concave shape of end plate 74 can be made to better match the convex shape of the tips of wraps 58 of orbiting scroll member 56 while simultaneously causing the tips of wraps 72 of non-orbiting scroll member 70 to become generally planar. In this manner, the proper sealing between the tips of wraps 58 and 72 and the surfaces of end plates 74 and 60 respectively will be maintained at normal operating temperature as well as during the transition between normal environmental temperatures and normal operating temperatures.

Figure 6A:
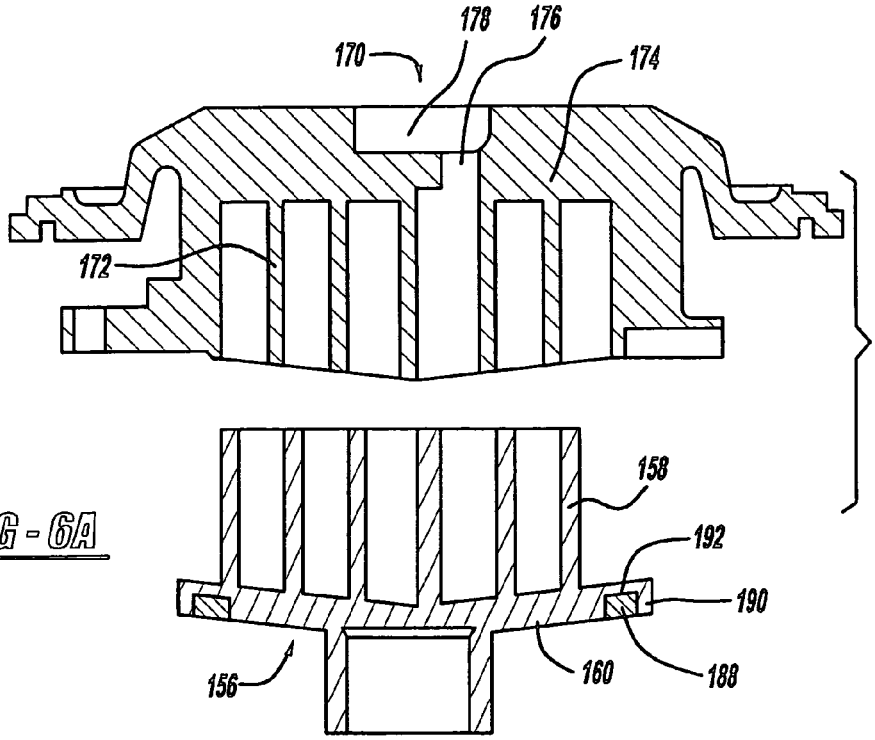
FIG. 6 is a schematic view of an orbiting and non-orbiting scroll members at an elevated operating temperature with the influence of a compensation member in accordance with another embodiment of the present disclosure.
Figure 6B:
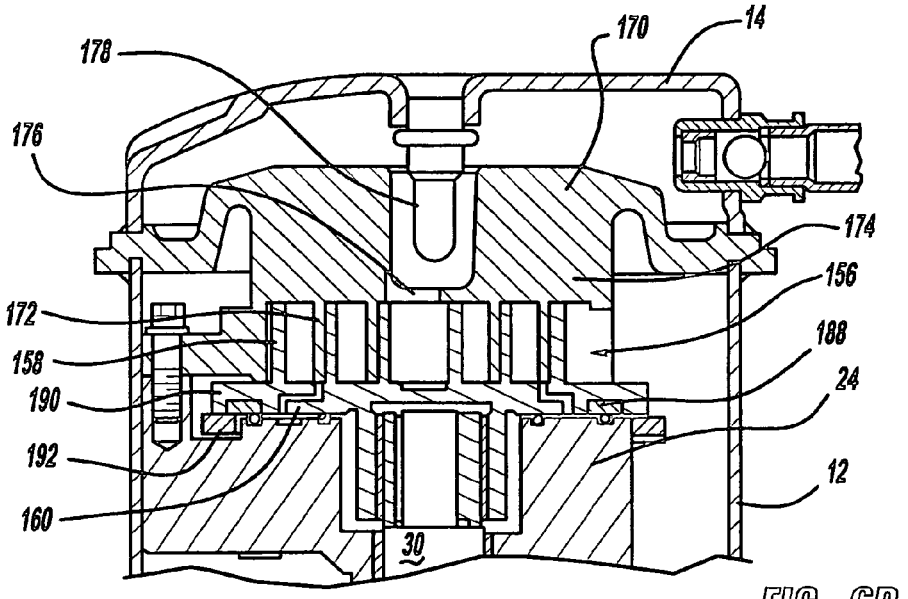

Referring now to FIGS. 6A and 6B, a compensation system in accordance with another embodiment of the present disclosure is illustrated. FIGS. 4 and 5 illustrate annular ring 88 attached to non-orbiting scroll member 70. FIG. 6 illustrates an annular ring 188 attached to an orbiting scroll member 156.

Orbiting scroll member 156 includes the usual spiral valve or wrap 158 extending upward from an end plate 160. Projecting downwardly from the lower surface of end plate 160 of orbiting scroll member 156 is a cylindrical hub for accommodating journal bearing 62 and drive bushing 64.

A non-orbiting scroll member 170 is designed to mate with orbiting scroll member 156. Non-orbiting scroll member 170 is provided with a wrap 172 extending downwardly from an end plate 174 which is positioned in meshing engagement with scroll wrap 158 of orbiting scroll member 156. Non-orbiting scroll member 170 has a centrally disposed discharge passage 176 which communicates with an upwardly open recess 178 which is designed to be in fluid communication with discharge muffler chamber 80.

Orbiting scroll member 156 defines an annular flange 190 projecting downwardly from the lower surface of end plate 160 of orbiting scroll member 156. Annular flange 190 defines an annular groove 192 within which is located annular ring 188. Annular ring 188 is press fit within annular groove 192 or secured within annular groove 192 by other means known in the art. The reaction to temperature change or the coefficient of thermal expansion of the material of annular ring 188 is greater than the reaction to temperature change or the coefficient of thermal expansion of the material orbiting scroll member 156.

FIG. 6A schematically illustrates the operating principles for this embodiment of the temperature compensation system. At normal environmental or room temperature, the surface of end plate 160 extending between scroll wrap 158 is formed as a generally planar surface similar to that illustrated in FIG. 4 for scroll wrap 58 and end plate 60. Similarly, the surface of end plate 174 extending between scroll wrap 172 is also formed as a generally planar surface similar to that illustrated in FIG. 4 for scroll wrap 72 and end plate 74. In this manner, when orbiting scroll member 156 and non-orbiting scroll member 170 are assembled at room temperature, the flank surfaces of scroll wraps 158 and 172 engage each other, the tip of scroll wrap 158 engages end plate 174 and the tip of scroll wrap 172 engages end plate 160 to provide for the sealing of the compression pockets.

FIG. 6A illustrates the thermal expansion effects due to normal operating temperature on orbiting scroll member 156 and non-orbiting scroll member 170 with the compensation effect of annular ring 188. It has been observed that end plate 174 remains generally planar. The incorporation of annular ring 188 does not affect the thermal growth resulting in the convex shape of wraps 172. The effect of the incorporation of annular ring 188 is only on orbiting scroll member 156. As the temperature of orbiting scroll member 156 increases, the temperature of annular ring 188 also increases. This causes thermal expansion of annular ring 188 in an amount which is greater than the thermal expansion of annular flange 190 due to the differences in the coefficients of thermal expansion of their materials. This difference in thermal expansion will produce a load on annular flange 190 which will cause end plate 160 to form a concave surface which will eliminate the convex shape for the tips of wrap 158. With the proper selection of materials and the proper dimensioning of the components, the concave shape of end plate 160 can be made to better match the convex shape of the tips of wraps 172 of non-orbiting scroll member 120 while simultaneously causing the tips of wraps 158 of orbiting scroll member 156 to become generally planar. In this manner, the proper sealing between the tips of wraps 158 and 172 and the surfaces of end plates 174 and 160 respectively will be maintained at normal operating temperature as well as during the transition between normal environmental temperatures and normal operating temperatures.

The temperature compensation system illustrated in FIG. 6A can be used in scroll compressor 10 which utilizes axial movable non-orbiting scroll member 70. Because annular ring 188 is disposed in base plate 160 of orbiting scroll member 156 and the fact that the back surface of base plate 160 is a thrust bearing surface in scroll compressor 10, this compensation system may be more appropriate for a compressor 110 illustrated in FIG. 6B.

Scroll compressor 110 fixes the position of non-orbiting scroll member 170 and orbiting scroll member 156 is provided with axial movement as is well known in the art. Scroll compressor 110 having axial compliant orbiting scroll member 156 is more tolerant of a convex shaped back surface than scroll compressor 10.

Figure 7:
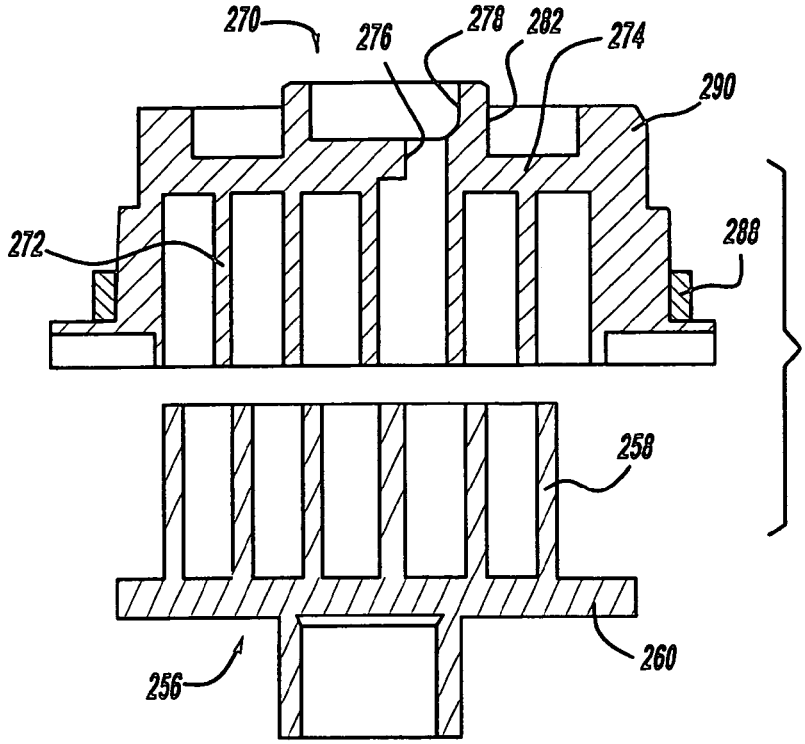
FIG. 7 is a schematic view of an orbiting and non-orbiting scroll members in accordance with another embodiment of the present disclosure.
Figure 8:
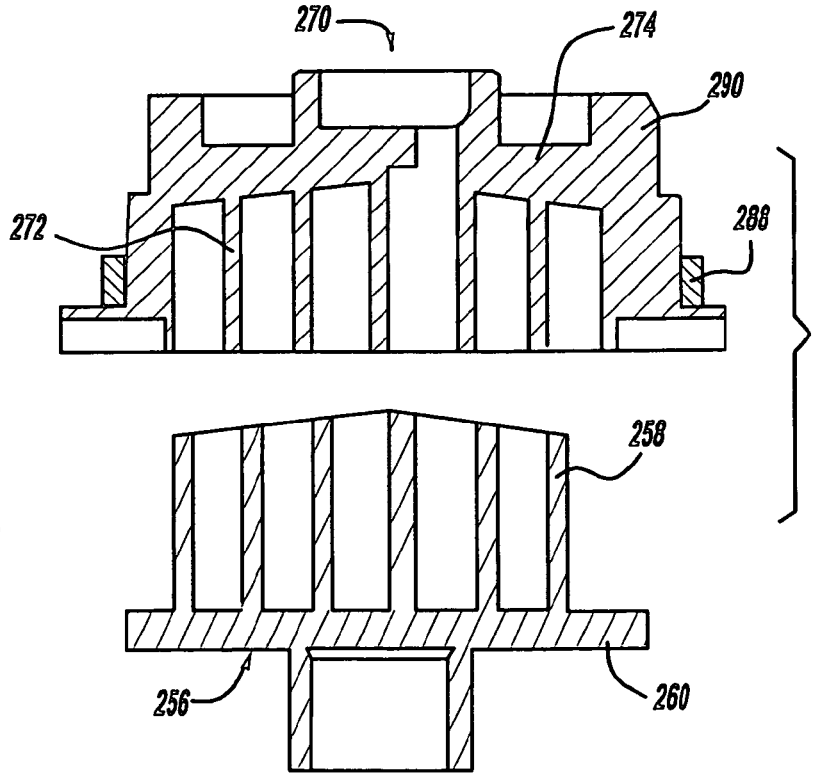
FIG. 8 is a schematic view of the orbiting and non-orbiting scroll members shown in FIG. 7 at an elevated temperature with the influence of the compensation member.

FIGS. 7 and 8 schematically illustrate the operating principles of a temperature compensation system in accordance with another embodiment of the disclosure. The temperature compensation system in FIGS. 7 and 8 comprises an annular ring 288 attached to a non-orbiting scroll member 270.

An orbiting scroll member 256 includes the usual spiral vane or wrap 258 extending upward from an end plate 260. Projecting downwardly from the lower surface of end plate 260 of orbiting scroll member 256 is a cylindrical hub for accommodating journal bearing 62 and drive bushing 64. Orbiting scroll member 256 is a direct replacement for orbiting scroll member 56.

Non-orbiting scroll member 270 is a direct replacement for non-orbiting scroll member 70 and non-orbiting scroll member 270 is designed to mate with orbiting scroll member 256. Non-orbiting scroll member 270 is provided with a wrap 272 extending downwardly from an end plate 274 and wrap 272 is positioned in meshing engagement with scroll wrap 258 of orbiting scroll member 256. Non-orbiting scroll member 270 has a centrally disposed discharge passage 276 which communicates with an upwardly open recess 278 which is designed to be in fluid communication with discharge muffler chamber 80. An annular recess 282 is also formed in non-orbiting scroll member 270 to accept seal assembly 84.

Non-orbiting scroll member 270 defines an annular portion 290 over which annular ring 288 is located. Annular ring 288 is press fit over annular portion 290 or secured to annular portion 290 by other means known in the art. The reaction to temperature change or the coefficient of thermal expansion for the material of annular ring 288 is less than the reaction to temperature change or the coefficient of thermal expansion of the material of non-orbiting scroll member 270. Annular ring 288 may be manufactured from standard wrought materials, composite materials, shaped memory alloys, phase change alloys or any other material known in the art that can provide the desired results.

FIGS. 7 and 8 schematically illustrate the operating principles for the temperature compensation system similar to that shown in FIG. 1. FIG. 7 illustrates orbiting scroll member 256 and non-orbiting scroll member 270 at a normal environmental or room temperature. The surface of end plate 260 extending between scroll wrap 258 is formed as a generally planar surface. Similarly, the surface of end plate 274 extending between scroll wrap 272 is also formed as generally planar surface. In this manner, when orbiting scroll member 256 and non-orbiting scroll member 270 are assembled at room temperature, the flank surfaces of scroll wraps 258 and 272 engage each other, the tip of scroll wrap 258 engages end plate 274 and the tip of scroll wrap 272 engages end plate 260 to provide for the sealing of the compression pockets.

FIG. 8 illustrates the thermal expansion effects due to the normal operating temperature of orbiting scroll member 256 and non-orbiting scroll member 270 with the compensation effect of annular ring 288. It has been observed that end plate 260 remains generally planar and provides continued proper engagement with generally flat thrust bearing surface 54 of main bearing housing 24. The incorporation of annular ring 288 does not affect the thermal growth resulting in the convex shape of wraps 258. The effect of the incorporation of annular ring 288 is only on non-orbiting scroll member 270. As the temperature of non-orbiting scroll member 270 increases, the temperature of annular ring 288 also increases. This causes thermal expansion of annular ring 288 in an amount which is less than the thermal expansion of annular portion 290 due to the differences in the coefficients of thermal expansion of their materials. This difference in thermal expansion will produce a load on annular portion 290 which will cause end plate 274 to form a concave surface which will reduce or eliminate the convex shape for the tips of wrap 272. With the proper selection of materials, such as high nickel alloys or filament wound carbon fiber based composite materials which have a coefficient of thermal expansion lower than that of scroll members made of grey iron to choose from typical engineered materials, and the proper dimensioning of the components, the concave shape of end plate 274 can be made to better match the convex shape of the tip of wrap 258 of orbiting scroll member 256 while simultaneously causing the tip of wrap 272 of non-orbiting scroll member 270 to become generally planar. In this manner, the proper sealing between the tips of wraps 258 and 272 and the surfaces of end plates 274 and 260, respectively, will be maintained at normal operating temperature as well as during the transition between normal environmental temperatures and normal operating temperatures.

Figure 9:
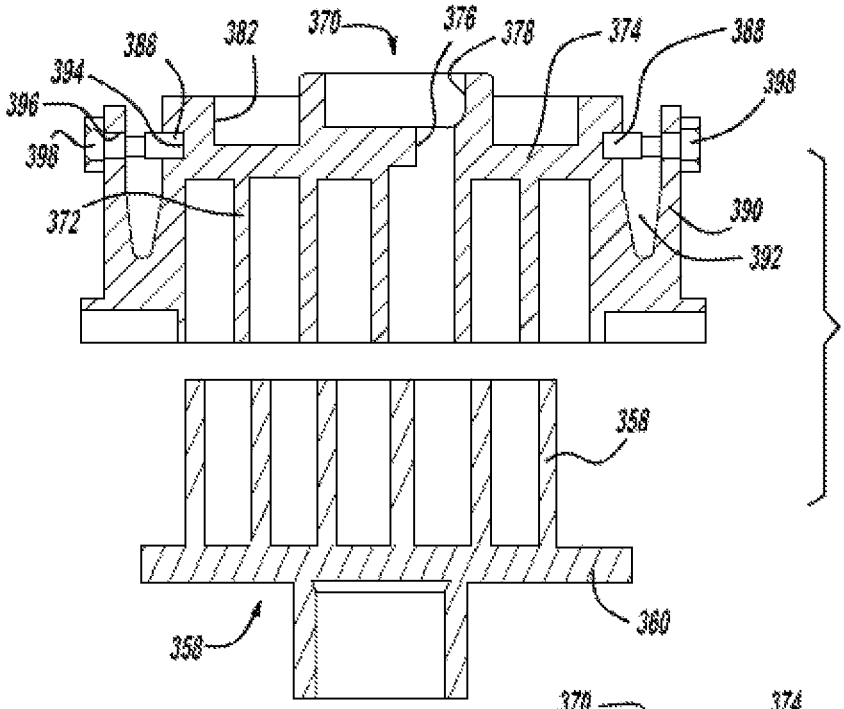
FIG. 9 is a schematic view of an orbiting and non-orbiting scroll members in accordance with another embodiment of the present disclosure.
Figure 10:
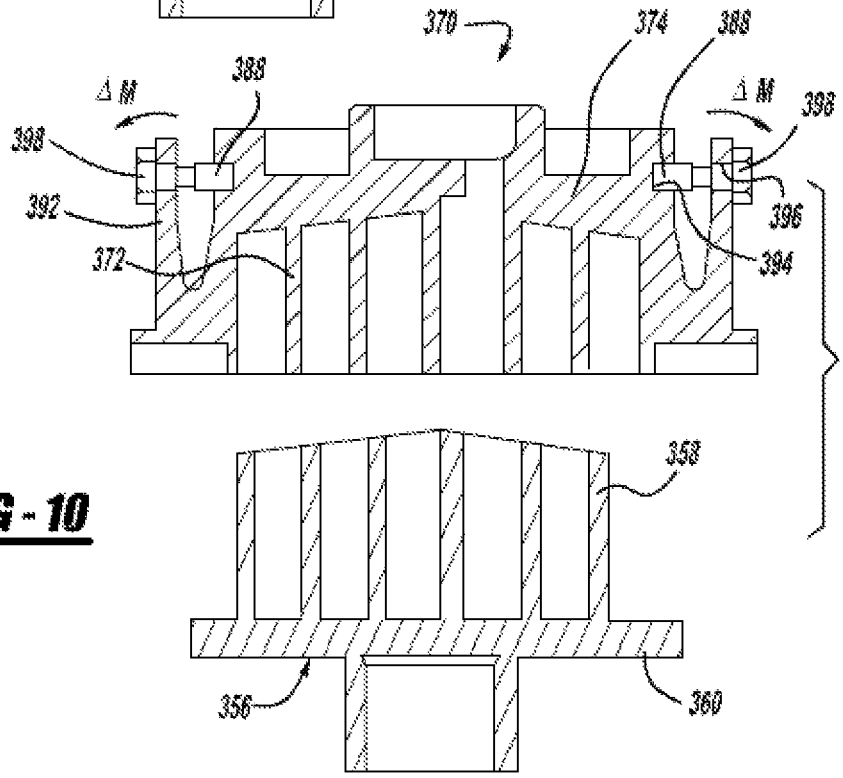
FIG. 10 is a schematic view of the orbiting and non-orbiting scroll members shown in FIG. 7 at an elevated temperature with the influence of the compensation member.
Figure 11:
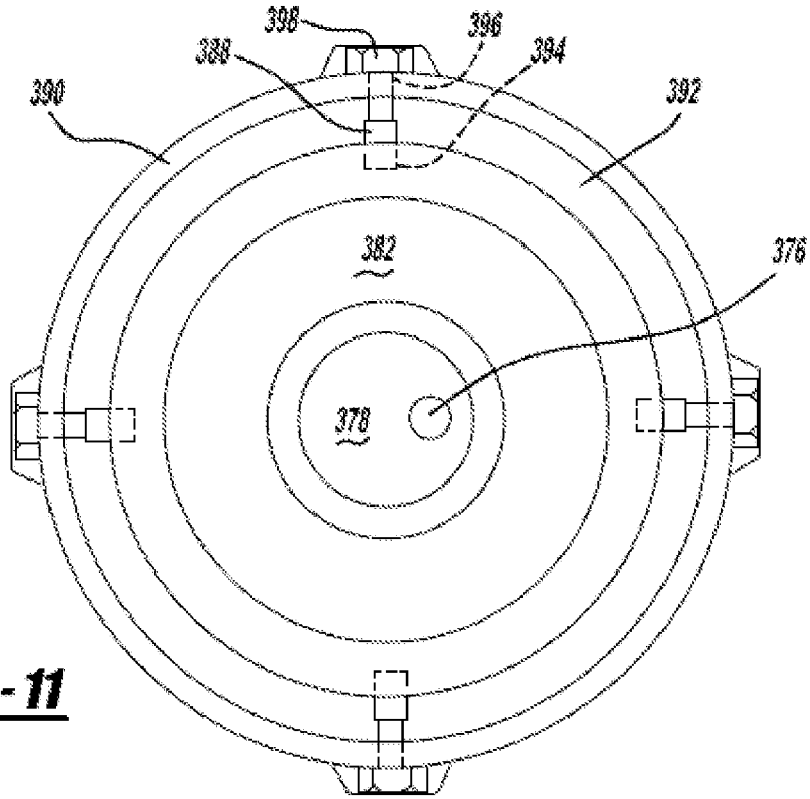
FIG. 11 is a top plan view of the non-orbiting scroll member illustrated in FIGS. 9 and 10.

FIGS. 9-11 schematically illustrate the operating principles of a temperature compensation system in accordance with another embodiment of the present disclosure. The temperature compensation system in FIGS. 9-11 comprises a plurality of thermal actuators 388 attached to a non-orbiting scroll member 370.

An orbiting scroll member 356 includes the usual spiral vane or wrap 358 extending upward from an end plate 360. Projecting downwardly from the lower surface of end plate 360 of orbiting scroll member 356 is a cylindrical hub for accommodating journal bearing 62 and drive bushing 64. Orbiting scroll member 356 is a direct replacement for orbiting scroll member 56.

Non-orbiting scroll member 370 is a direct replacement for non-orbiting scroll member 70 and non-orbiting scroll member 370 is designed to mate with orbiting scroll member 356. Non-orbiting scroll member 370 is provided with a wrap 372 extending downwardly from an end plate 374 and wrap 372 is positioned in meshing engagement with scroll wrap 358 of orbiting scroll member 356. Non-orbiting scroll member 370 has a centrally disposed discharge passage 376 which communicates with an upwardly open recess 378 which is designed to be in fluid communication with discharge muffler chamber 80. An annular recess 382 is also formed in non-orbiting scroll member 370 to accept seal assembly 84.

Non-orbiting scroll member 370 defines an annular flange 390 projecting upwardly from end plate 374 of non-orbiting scroll member 370. Annular flange 390 defines an annular groove 392. Non-orbiting scroll member 370 further defines a plurality of bores 394 within each of which is disposed a respective thermal actuator 388. Annular flange 390 defines a plurality of bores 396 each of which is aligned with a respective bore 394. A fastener 398 is assembled into each bore 396 to provide cold temperature adjustment to a respective thermal actuator. As illustrated in FIG. 11, the present disclosure includes four bores 394, four thermal actuators 388, four bores 396 and four fasteners 398. It is to be understood that the present disclosure is not limited to four thermal actuators but the present disclosure can have fewer or more thermal actuators 388 as determined by the specific design and development requirements.

Figure 13:
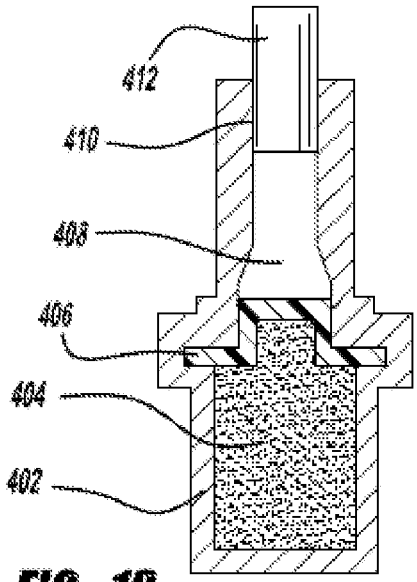
FIG. 13 is a cross-sectional view of the thermal actuator illustrated in FIG. 12 at normal operating temperatures.
Figure 12:
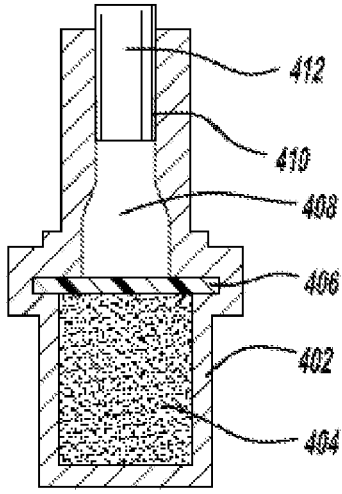
FIG. 12 is a cross-sectional view of one of the thermal actuators illustrated in FIGS. 9 and 10 at normal environmental temperature.

Referring to FIGS. 12 and 13, thermal actuator 388 is illustrated in greater detail. Thermal actuator 388 comprises a cup 402, a thermal expansion material 404, a diaphragm 406, a plug 408, a guide 410 and a piston 412. Thermal expansion material 404 is disposed within cup 402 and diaphragm 406 seals and retains thermal expansion material 404 within cup 402. Plug 408 and piston 412 are assembled within guide 410 and guide 410 is secured to cup 402 to complete the assembly of thermal actuator 388. Guide 410 is secured to cup 402 by welding, by the use of a retainer (not shown), by a threaded connection or by any other means known in the art.

FIG. 12 illustrates thermal actuator 388 in its cold or non-actuated condition. Thermal expansion material 404 is disposed within cup 402 in a solid state and piston 412 is in its retracted position. FIG. 13 illustrates thermal actuator 388 in its heated or actuated condition. Thermal expansion material 404 reacts to heat by changing into a liquid material and expanding to push diaphragm 406 upward as illustrated in FIG. 13. Diaphragm 406 pushes plug 408 upward which in turn pushes piston 412 into its extended position as illustrated in FIG. 13. When thermal expansion material 404 cools, it returns to its solid condition as illustrated in FIG. 12.

FIGS. 9 and 10 schematically illustrate the operating principles for the temperature compensation system for this embodiment. FIG. 9 illustrates orbiting scroll member 356 and non-orbiting scroll member 370 at a normal environmental or room temperature. The surface of end plate 360 extending between scroll wrap 358 is formed as a generally planar surface. Similarly, the surface of end plate 274 extending between scroll wrap 272 is also formed as a generally planar surface. In this manner when orbiting scroll member 356 and non-orbiting scroll member 370 are assembled at room temperature, the flank surfaces of scroll wraps 358 and 372 engage each other, the tip of scroll wrap 358 engages end plate 374 and the tip of scroll wrap 372 engages end plate 360 to provide for the sealing of the compression pockets.

FIG. 10 illustrates the thermal expansion effects due to the normal operating temperature of orbiting scroll member 356 and non-orbiting scroll member 370 with the compensation effect of thermal actuators 388. It has been observed that end plate 360 remains generally planar and provides continued proper engagement with flat thrust bearing surface 54 of main bearing housing 24. The incorporation of thermal actuators 388 does not affect the thermal growth resulting in the convex shape of wraps 358. The effect of the incorporation of thermal actuators 388 is only on non-orbiting scroll member 370. As the temperature of non-orbiting scroll member 370 increases, the temperature of thermal actuators 388 also increases. This causes the melting and expansion of thermal expansion material 440 in thermal actuators. This expansion of thermal expansion material 440 pushes pistons 412 outward, as detailed above, to apply a force to the upper end of annular flange 390 and the force applied to annular flange 390 by thermal actuators 388 will cause end plate 374 to form a concave surface which will reduce or eliminate the convex shape for the tips of wrap 372. With the proper selection of the number and type of thermal actuators 388, the concave shape of end plate 374 can be made to much better match the convex shape of the tip of wrap 358 of orbiting scroll member 356 while simultaneously causing the tip of wrap 372 of non-orbiting scroll member 370 to become generally planar to match end plate 360 of orbiting scroll member 356. In this manner, the proper sealing between the tips of wraps 358 and 372 and the surfaces of end plates 374 and 360, respectively, will be maintained at normal operating temperatures as well as during the transition between normal environmental temperatures and normal operating temperatures. Fasteners 398 are adjustable to provide for the room temperature position of fasteners 398 with respect to thermal actuators 388 to insure equal loads around the circumference of annular flange 390.

While the above detailed description describes the preferred embodiment of the present disclosure, it should be understood that the present disclosure is susceptible to modification, variation and alteration without deviating from the scope and fair meaning of the subjoined claims.

What is claimed is:

1. A scroll machine comprising:

a first scroll member including a first end plate having a first spiral wrap extending therefrom;

a second scroll member including a second end plate having a second spiral wrap extending therefrom, said second spiral wrap being intermeshed with said first spiral wrap such that a distal end of said first spiral wrap engages said second end plate and a distal end of said second spiral wrap engages said first end plate;

a drive member for causing said scroll members to orbit relative to one another whereby said spiral wraps create pockets of progressively changing volume between a suction pressure zone and a discharge pressure zone; and a compensation member positioned proximate to one of said first and second scroll members and having a reaction to a temperature change of said compensation member deforming said one of said first and second scroll members to compensate for deformation of the other of said first and second scroll members.

2. The scroll machine according to claim 1, wherein said one scroll member is an axial compliant scroll member.

3. The scroll machine according to claim 2, wherein said one scroll member is a non-orbiting scroll member.

4. The scroll machine according to claim 2, wherein said one scroll member is an orbiting scroll member.

5. The scroll machine according to claim 1, wherein said one scroll member is a non-axial compliant scroll member.

6. The scroll machine according to claim 1, wherein said compensation member is an annular ring.

7. The scroll machine according to claim 6, wherein said one scroll member is formed from a material having a reaction to temperature change of said one scroll member that is less than said reaction to temperature change of said compensation member.

8. The scroll machine according to claim 7, wherein said one scroll member is a non-orbiting scroll member.

9. The scroll machine according to claim 8, wherein said one scroll member is pressure biased against the other scroll member.

10. The scroll machine according to claim 7, wherein said one scroll member is an orbiting scroll member.

11. The scroll machine according to claim 10, wherein said one scroll member is pressure biased against the other scroll member.

12. The scroll machine according to claim 6, wherein said scroll member is formed from a material having a reaction to temperature change of said scroll member that is greater than said reaction to temperature change of said compensation member.

13. The scroll machine according to claim 1, wherein said one scroll member is a non-orbiting scroll.

14. The scroll machine according to claim 1, wherein said one scroll member is an orbiting scroll member.

15. The scroll machine according to claim 1, wherein said scroll member is formed from a material having a reaction to temperature change of said scroll member that is less than said reaction to temperature change of said compensation member.

16. The scroll machine according to claim 15, wherein said compensation member is a copper based material.

17. The scroll machine according to claim 15, wherein said compensation member is a ferrous based material with an austenitic structure.

18. The scroll machine according to claim 1, wherein said scroll member is formed from a material having a reaction to temperature change of said scroll member that is greater than said reaction to temperature change of said compensation member.

19. The scroll machine according to claim 18, wherein said compensation member is a high nickel alloy material.

20. The scroll machine according to claim 18, wherein said compensation member is a filament wound carbon fiber based composite material.

21. The scroll machine according to claim 1, wherein said one scroll member defines an internal diameter and said compensation member is an annular ring secured within said internal diameter.

22. The scroll machine according to claim 21, wherein said scroll member is formed from a material having a reaction to temperature change of said scroll member that is less than said reaction to temperature change of said compensation member.

23. The scroll machine according to claim 21, wherein said one scroll member is an axial compliant scroll member.

24. The scroll machine according to claim 21, wherein said one scroll member is a non-axial compliant scroll member.

25. The scroll machine according to claim 1, wherein said one scroll member includes an end plate having a planar surface, said deflection of said one scroll member causing said planar surface of said end plate to form a concave surface.

26. The scroll machine according to claim 25, wherein said compensation member is an annular ring.

27. The scroll machine according to claim 26, wherein said scroll member is formed from a material having a reaction to temperature change of said scroll member that is less than said reaction to temperature change of said compensation member.

28. The scroll machine according to claim 26, wherein said scroll member is formed from a material having a reaction to temperature change of said scroll member that is greater than said reaction to temperature change of said compensation member.

29. The scroll machine according to claim 1, wherein said compensation member is a plurality of thermal actuators.

30. The scroll machine according to claim 29, wherein said plurality of thermal actuators are circumferentially spaced around said one scroll member.

31. The scroll machine according to claim 29, wherein at least one of said plurality of thermal actuators utilizes a material phase change.

32. The scroll machine according to claim 29, wherein at least one of said plurality of thermal actuators is a memory material.

33. The scroll machine of claim 1, wherein said reaction to temperature change of said compensation member causes said one of said first and second scroll members to maintain a sealed relationship between said distal end of said first spiral wrap and said second end plate and between said distal end of said second spiral wrap and said first end plate at said suction pressure zone and said discharge pressure zone.

34. A scroll machine comprising:

a non-orbiting scroll member having a first spiral wrap projecting outward from a first end plate;

an orbiting scroll member having a second spiral wrap projecting outward from a second end plate, said second spiral wrap being intermeshed with said first spiral wrap such that a distal end of said first spiral wrap engages said second end plate and a distal end of said second spiral wrap engages said first end plate;

a drive member for causing said orbiting scroll member to orbit relative to said non-orbiting scroll member whereby said spiral wraps create pockets of progressively changing volume between a suction pressure zone and a discharge pressure zone; and a compensation member deforming one of said orbiting and non-orbiting scroll members to compensate for deformation of the other of said orbiting and non-orbiting scroll members, said compensation member being formed from a first material having a first coefficient of thermal expansion, said one of said orbiting and non-orbiting scroll members being formed from a second material having a second coefficient of thermal expansion different than said first coefficient of thermal expansion.

35. The scroll machine according to claim 34, wherein said one scroll member is an axial compliant scroll member.

36. The scroll machine according to claim 34, wherein said one scroll member is a non-axial compliant scroll member.

37. The scroll machine according to claim 34, wherein said compensation member causes said one scroll member to deflect through tensile stress.

38. The scroll machine according to claim 34, wherein said compensation member causes said one scroll member to deflect through compressive stress.

39. The scroll machine according to claim 34, wherein said compensation member is an annular ring.

40. The scroll machine according to claim 34, wherein said non-orbiting scroll member and said orbiting scroll member are made from grey iron and the compensation member is a ring.

41. The scroll machine according to claim 34, wherein said first coefficient of thermal expansion is greater than said second coefficient of thermal expansion.

42. The scroll machine according to claim 34, wherein said first coefficient of thermal expansion is less than said second coefficient of thermal expansion.

43. The scroll machine according to claim 34, wherein said one scroll member defines an internal diameter and said compensation member is an annular ring secured within said internal diameter.

44. The scroll machine according to claim 34, wherein said end plate of said one scroll member includes a planar surface, said deflection of said one scroll member causing said planar surface to form a concave surface.

45. The scroll machine of claim 34, wherein said compensation member causes said one of said orbiting and non-orbiting scroll members to maintain a sealed relationship between said distal end of said first spiral wrap and said second end plate and between said distal end of said second spiral wrap and said first end plate at said suction pressure zone and said discharge pressure zone upon heating of said compensation member.

* * * * *